US010690343B2

(12) United States Patent
Hazard

(10) Patent No.: US 10,690,343 B2
(45) Date of Patent: Jun. 23, 2020

(54) UNIVERSAL CHIMNEY PIPE COVER

(75) Inventor: Thomas Hazard, Walden, NY (US)

(73) Assignee: Top Hat Chimney Systems, Inc., Newburgh, NY (US)

( * ) Notice: Subject to any disclaimer, the term of this patent is extended or adjusted under 35 U.S.C. 154(b) by 748 days.

(21) Appl. No.: 13/562,100

(22) Filed: Jul. 30, 2012

(65) Prior Publication Data

US 2013/0189915 A1 Jul. 25, 2013

Related U.S. Application Data

(60) Provisional application No. 61/513,719, filed on Aug. 1, 2011.

(51) Int. Cl.
*F23J 13/02* (2006.01)
*F23J 13/06* (2006.01)

(52) U.S. Cl.
CPC ..... *F23J 13/02* (2013.01); *F23J 13/06* (2013.01); *F23J 2213/101* (2013.01); *F23J 2213/303* (2013.01); *F23J 2900/13021* (2013.01)

(58) Field of Classification Search
CPC ..... F23J 13/02; F23J 13/06; F23J 2213/101; F23J 2213/303; F23J 2900/13021
USPC ..... 454/47, 14, 12, 4, 47.14
See application file for complete search history.

(56) References Cited

U.S. PATENT DOCUMENTS 558,025 A * 4/1896 Barry, Jr. ..... E04D 13/1476 126/314
696,139 A 3/1902 Granton
836,933 A 11/1906 Lauth
1,137,778 A 5/1915 Moore
2,362,557 A * 11/1944 Jahns ..... F16L 23/08 285/192
2,766,678 A * 10/1956 Morris ..... 454/12
2,621,900 A 2/1958 Primich
2,962,053 A 3/1958 Epstein
2,916,983 A * 12/1959 Kinkead ..... F23J 13/025 126/307 R
2,956,495 A 10/1960 Sublette
2,976,796 A * 3/1961 Anthony et al. ..... 454/14
3,158,964 A * 12/1964 Haas ..... E04B 1/2612 24/704.1
3,313,559 A * 4/1967 Kifer ..... E04D 13/1476 285/136.1
3,330,233 A 7/1967 Clements
3,577,654 A * 5/1971 Marley ..... A24B 1/02 34/231

(Continued)

*Primary Examiner* — Steven B McAllister
*Assistant Examiner* — Allen R Schult
(74) *Attorney, Agent, or Firm* — Dergosits & Noah LLP; Michael E. Dergosits

(57) ABSTRACT

A covering system that covers an end pipe of a chimney system. A portion of the end pipe protrudes from the roof of a house or building where the chimney system is located. The system comprises of at least two base supports that sit on the roof. A channel spanning around the end pipe of the chimney system that protrudes from the roof. The base supports are attached at the base of the channel. The base has a protruding section whose dimensions are larger than the channel. A collar covering having a first and a second opening. The collar covers the protruding section of the base by its first opening and receives the channel at its second opening. A crown top base that slides inside of the channel from the top.

12 Claims, 5 Drawing Sheets

(56) References Cited

U.S. PATENT DOCUMENTS 3,871,145 A * 3/1975 Hatmaker ..... E04D 13/1407 138/162
3,872,780 A 3/1975 Zanias
3,902,744 A 9/1975 Stone
4,115,961 A 9/1978 Bishop
4,181,119 A 1/1980 Lyles
4,182,378 A * 1/1980 Dieter ..... F16L 7/00 138/112
4,206,692 A 6/1980 Johnston
4,262,608 A * 4/1981 Jackson ..... F23J 13/025 110/162
4,334,460 A * 6/1982 Simmons et al. ..... 454/4
4,436,021 A * 3/1984 Hisey ..... 454/12
4,437,687 A * 3/1984 Wilson ..... E04D 13/1407 285/136.1
4,442,643 A * 4/1984 Stadheim ..... E04F 17/04 285/44
4,534,280 A * 8/1985 Hisey ..... 454/14
4,535,686 A * 8/1985 Hisey ..... 454/14
4,549,473 A * 10/1985 Alexander et al. ..... 454/14
4,581,863 A * 4/1986 Thaler ..... E04D 13/1407 248/354.3
4,691,624 A 9/1987 Moore
4,697,500 A * 10/1987 Hisey ..... 454/35
4,724,750 A * 2/1988 Coleman ..... F23J 13/025 126/307 R
4,732,078 A * 3/1988 Giumenta et al. ..... 454/3
4,815,934 A * 3/1989 Rademaker ..... F04D 29/441 415/191
4,929,000 A * 5/1990 Annestedt, Sr. ..... E04F 17/02 138/148
4,970,837 A 11/1990 Fogelstrom
5,129,690 A * 7/1992 Meinig ..... F16L 23/08 285/363
5,135,270 A * 8/1992 Arnoldt ..... F16L 23/08 285/363
5,226,263 A * 7/1993 Merrin ..... E04D 13/1476 285/42
5,245,804 A * 9/1993 Schiedegger ..... E04D 13/1476 285/43
5,390,451 A * 2/1995 Kopp ..... E04D 13/1471 285/43
5,402,613 A * 4/1995 Giumenta et al. ..... 52/244
5,468,026 A 11/1995 Annestedt
5,503,231 A * 4/1996 Palmatier ..... A62C 4/04 169/54
5,536,048 A * 7/1996 Orr ..... E04D 13/1407 110/184
5,694,724 A 12/1997 Santiago
5,876,276 A * 3/1999 Arbucci ..... 454/35
5,946,863 A * 9/1999 Bullard ..... E04D 13/1476 285/42
6,022,269 A * 2/2000 Arbucci ..... 454/12
6,066,039 A 5/2000 Cowen
6,244,006 B1 * 6/2001 Shue et al. ..... 52/302.1
6,279,272 B1 * 8/2001 Nill, Jr. ..... E04D 13/1471 285/43
6,516,750 B1 * 2/2003 Heinzeroth ..... A01K 31/06 119/428
6,591,561 B1 * 7/2003 Evensen ..... E04D 13/1407 285/42
6,640,503 B1 * 11/2003 Evensen ..... E04D 13/1407 277/602
6,648,748 B1 * 11/2003 Ferlin ..... F23J 11/02 454/65
D503,471 S * 3/2005 Huta ..... D23/398
6,918,827 B2 * 7/2005 Daniels et al. ..... 454/14
6,926,600 B1 * 8/2005 Arnold, Jr. ..... 454/12
6,997,798 B2 * 2/2006 Jensen ..... 454/4
7,014,555 B1 3/2006 Issod
D606,646 S 12/2009 Leatham
7,900,654 B2 3/2011 Moreau
8,083,574 B2 * 12/2011 Arnold et al. ..... 454/4
8,091,296 B2 * 1/2012 Horn ..... E04D 13/14 52/101
8,484,914 B2 * 7/2013 Cline ..... E04D 13/1476 52/219
8,490,351 B1 * 7/2013 Scott ..... E04D 13/1476 285/42
2004/0142652 A1 * 7/2004 Hediger ..... F23J 13/025 454/12
2004/0255523 A1 * 12/2004 Bibaud ..... E04D 13/1476 52/58
2005/0064806 A1 3/2005 Issod
2005/0150176 A1 * 7/2005 Erekson ..... E04D 13/1476 52/58
2006/0130411 A1 * 6/2006 Edgar ..... E04D 13/1476 52/58
2006/0211356 A1 9/2006 Grassman
2007/0101664 A1 * 5/2007 Hoy ..... E04D 13/1407 52/198
2007/0144600 A1 6/2007 Moreau
2007/0202790 A1 * 8/2007 Burns et al. ..... 454/4
2007/0221195 A1 * 9/2007 Bibaud ..... F23J 13/04 126/80
2008/0254729 A1 * 10/2008 Stubbert ..... F23J 13/02 454/3
2008/0318513 A1 * 12/2008 Adib ..... F24F 7/02 454/319
2011/0092147 A1 4/2011 D'Herville

* cited by examiner

UNIVERSAL CHIMNEY PIPE COVER

REFERENCES TO RELATED APPLICATIONS

This application claims benefit to U.S. Provisional Patent Application No. 61/513,719, filed Aug. 1, 2011, under 35 U.S.C. § 119(e). The disclosure of which is hereby incorporated by reference herein in its entirety for all purposes.

FIELD OF INVENTION

This invention relates to chimney cover, and more particularly, a chimney cover for covering the current aging chimney pipe on the roof of a house or any other building structure.

BACKGROUND OF THE INVENTION

A chimney is a structure that is used to vent flue gases or smoke from a boiler, stove, furnace or fireplace to the outside air. Typically, chimneys are made in a vertical shape for easy flow of the gases to the outer air. A chimney can be made a part of the structure of a house or a building. Generally, chimney pipes are installed from the floor of the house or building structure towards the roof, and are enclosed within the walls of the house of the building. Normally, the pipes are installed at the time when the house or building is being constructed. A chimney is generally made of metal pipes or masonry bricks. Any material used to build a chimney is enclosed within the walls of the house or building, and is usually protected from excessive wear and tear because the chimney inside the wall is not exposed to any environmental elements.

Part of the end portion of the chimney, however, is exposed to the environmental elements causing wear and tear. The end portion of the chimney that vents out the gases in the atmosphere is generally a circular or rectangular. This end portion of the chimney system starts beneath the roof and protrudes upwards through the roof where the chimney is located. The length of the end portion that protrudes from the roof is susceptible to the environmental elements such as rain, snow, heat, etc.

Due to the exposure to the environmental elements, the portion of the end pipe of the chimney system protruding from the roof of a house or a building wears faster than the rest of the unexposed portion of the end pipe or any other portion of the chimney system. One way to prevent this excessive wear is to cover the length of the end pipe protruding from the roof with an artificial chimney top cover. However, the artificial top cover is unable to completely protect the end pipe from further deterioration. A solution to correct this problem is to change the complete chimney system. However, changing the whole chimney system is cumbersome and is very expensive.

Therefore, there is a need of a system that can prevent excessive wear to the exposed portion of the end pipe protruding from the roof of a house or a building without changing the complete chimney system. The system should also be adjustable to be able to be used on any type of roof or roof pitch and with any size & type of the chimney system.

SUMMARY OF THE INVENTION

A covering system that covers an end pipe of a chimney system. A portion of the end pipe protrudes from the roof of a house or building where the chimney system is located.

The system comprises of at least two base supports that sit on the roof. A channel spanning around the end pipe of the chimney system that protrudes from the roof. The base supports are attached at the base of the channel. The base has a protruding section whose dimensions are greater than the channel. A collar covering having a first and a second opening. The collar covers the protruding portion of the base by its first opening and receives the channel at its second opening. A crown top base that slides inside of the channel from the top.

For further understanding of the advantages of the present invention, reference should be made to the following description taken in conjunction with the accompanying drawings.

DETAILED DESCRIPTION

Figure 1:
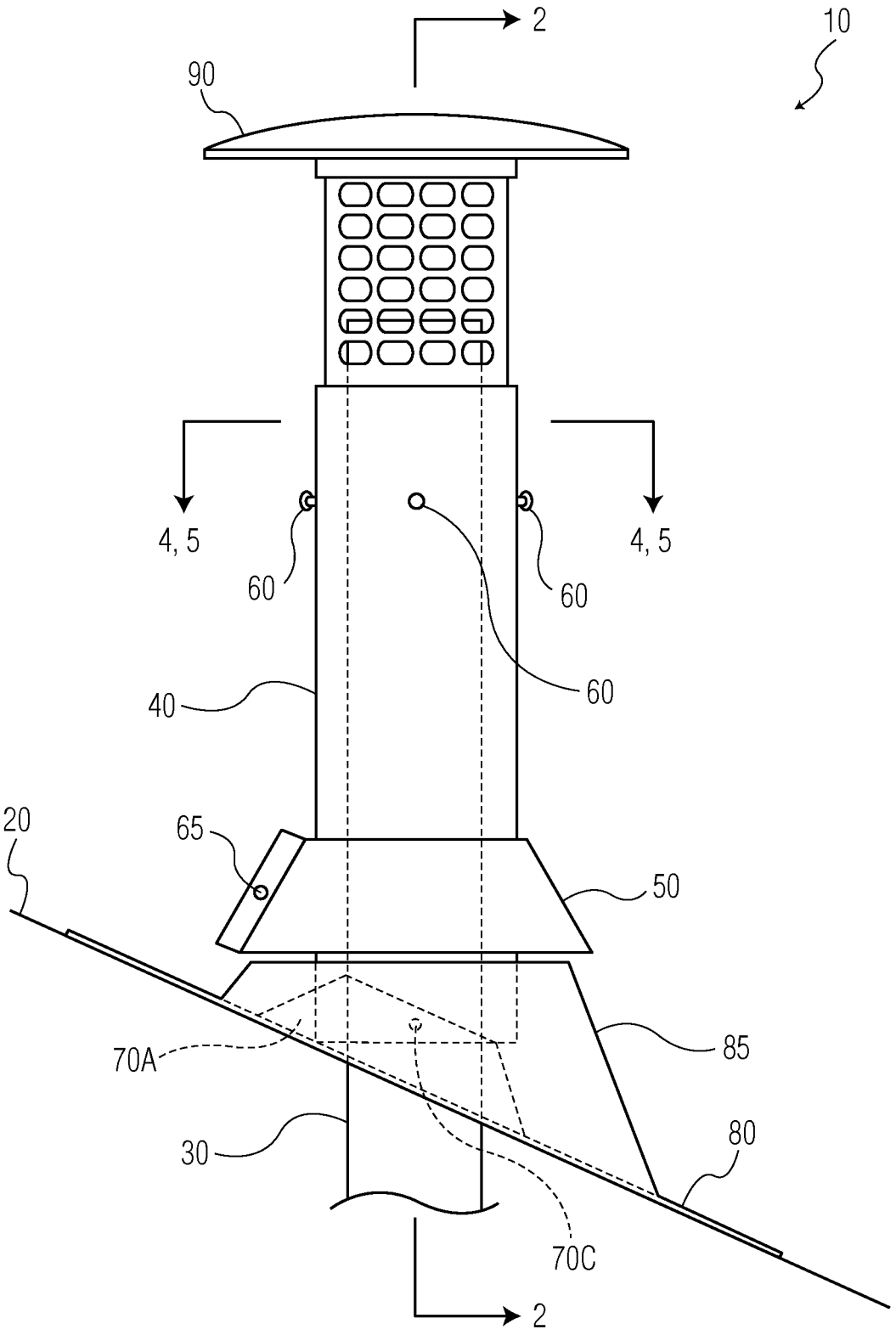
FIG. 1 is a lateral side view of the present invention covering the end pipe of a chimney system that protrudes from the roof of a home or a building.
Figure 2:
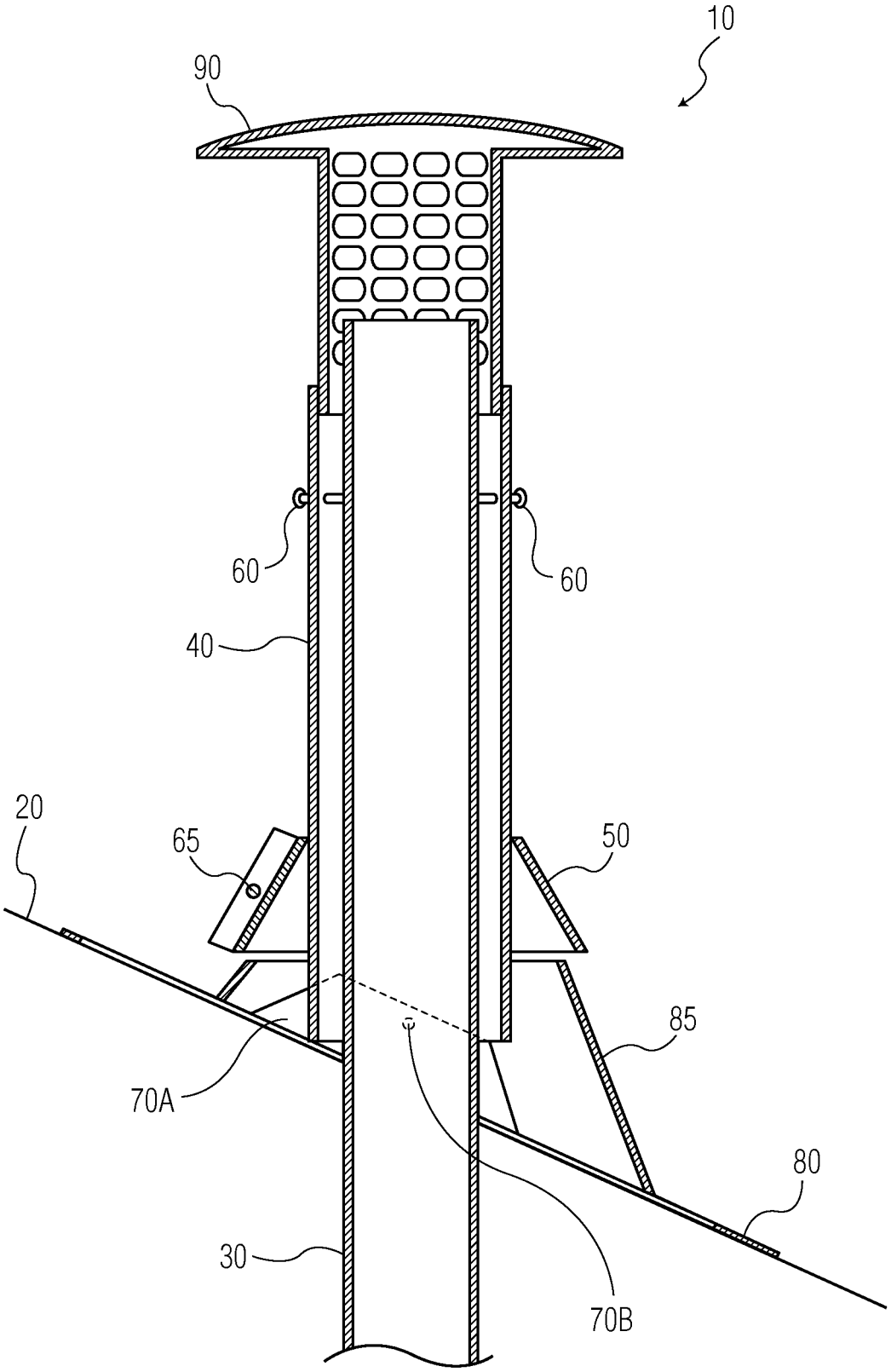
FIG. 2 is a lateral cross-section of FIG. 1 cut laterally at the points marked 2-2 in FIG. 1.

FIG. 1 is a lateral side view 10 of the top of a roof 20 where the end pipe 30 of a chimney system is protruding from the roof of a house or building in which the chimney system is installed. Generally, a portion of the end pipe 30 of the chimney system is inside the roof of a house or building and is connected to the chimney system. The remaining portion protrudes through the roof of the house or the building where the chimney system is located. The portion that protrudes from the roof vents out the gases. This end pipe of the chimney system is generally made of galvanized steel or similar alloy, and is generally circular in shape. However, some end pipes may be rectangular, square, or of any other shape. The protruding portion of the end pipe is susceptible to excessive wear & tear due to its exposure to rain, snow, heat, etc. This wear & tear is in addition to the wear & tear that the pipe normally has due to the gases passing through it. In order to stop the deterioration of the end pipe, it can be changed. However, to change the end pipe of the chimney system is expensive. Alternatively, the end pipe 30 is covered with a channel 40. The channel completely covers the portion of the end pipe that protrudes from the roof; thereby stopping any further deterioration of end pipe 30. The dimensions of the channel 40 are greater than the dimensions of the end pipe 30 that the channel covers. The dimensions of the channel can be customized according to the dimensions of the end pipe 30 of any chimney system, which is to be covered. The dimensions of the channel will depend upon shape and size of the end pipe, which is to be covered by the channel. The end pipe 30 can be circular, rectangular, square, etc. Similarly, the length of the channel will be adjusted according to the length of the end pipe 30 protruding from the roof, which is to be covered by the channel. In the preferred embodiment, the channel is made of stainless steel because it is cost-effective and lasts much longer than galvanized metal. In another embodiment, the channel of the present invention can be made of cooper or galvanized metal. The channel can be made of aluminum also; but it will understood by the persons of ordinary skill in the art that aluminum channel cannot be used only in the oil based chimney system.

Figure 6:
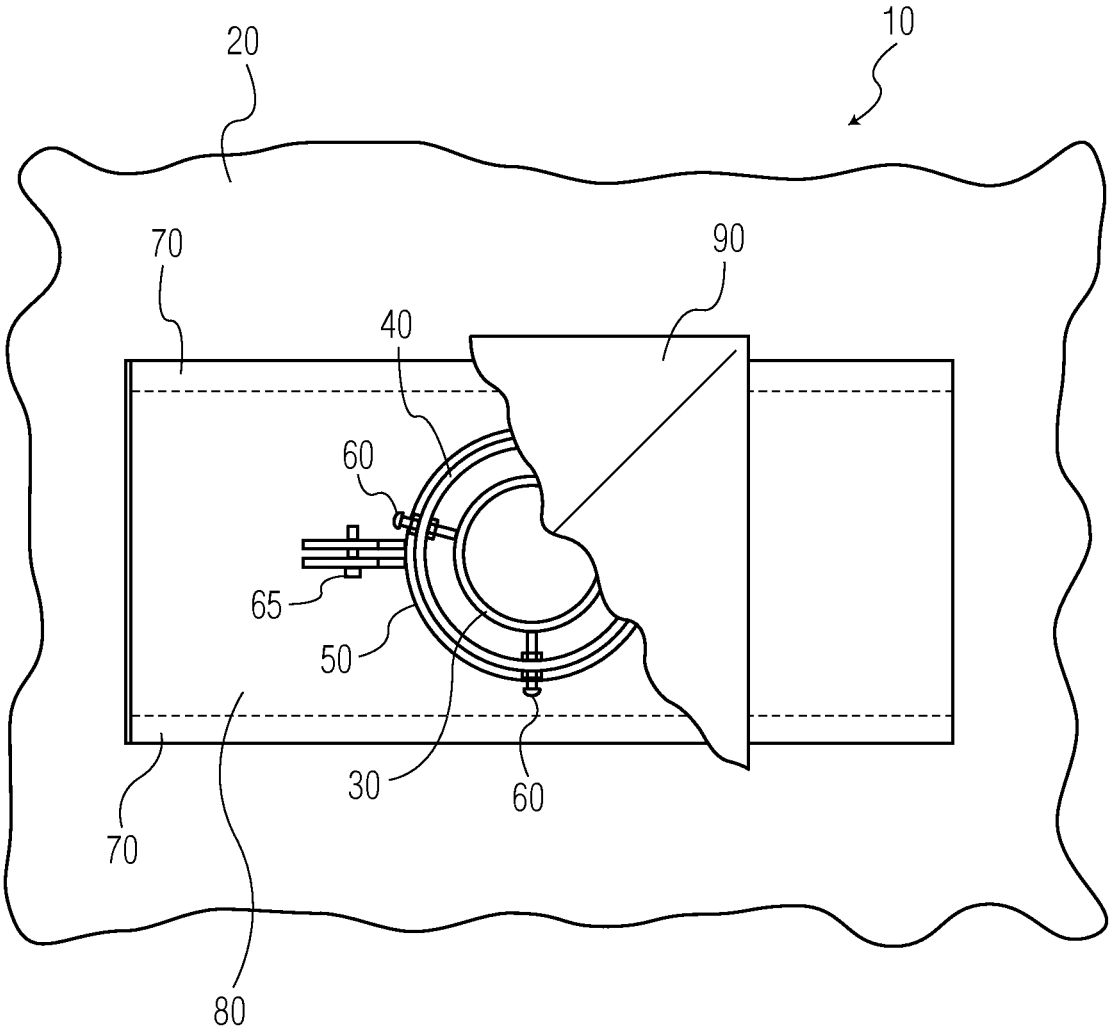
FIG. 6 is the aerial view of the system of the present invention.

In the preferred embodiment, base support 70 is attached using bolts at the end of the channel which will face the roof. The base support 70 is fixed in such a manner so that it can pivot along the longitudinal axis of the channel so as to fit on any angle of the roof or roof pitch. The preferred method of attaching the base support with the channel is by using bolts. However, there may be other ways, such as screws, rivets, etc. that can be used instead of the bolts. Generally, the base support is made of the same material as the channel. The base support is pre-attached with the channel 40 before it is installed on the roof. The channel 40 is then guided to cover the end pipe 30 such that the base support rests on the roof. Once the base support rests on the roof it is fixed on to the roof 20 using nails or screws. A base 80 is then placed and fixed on the roof of the house or building using screws or any other similar method. The base 80 is a generally a roof flashing that has a section 85 on its top protruding from the base's surface. The protruding section 85 of the base 80 generally covers 75% of the surface area of the base 80. The dimension of the protruding section 85 of base 80 is larger than the channel. The dimension of the protruding section 85 of the base 80 is such that it sits on top of the base support 70 and can completely cover the portion of base support 70 which is connected to the channel 40. The base 80 is also fixed on to the roof by screws or other similar means. Typically, the base 80 will completely cover the base support 70. However, a person of ordinary skill in the art may understand that depending upon the type of roof or roof pitch, the base 80 may not be able to completely cover base support 70. The protruding section 85 is generally adjustable, that is, it may be rotated around its circular axis. The flexibility of the section 85 allows the channel 40 to even cover a curved end pipe of the chimney system. The purpose of the base 80 is to act as a stable stand for the channel 40. FIG. 6 shows the placement of the base 80 on top of roof 20. It will be obvious to a person of ordinary skill in the art that there may be other means to provide a stable stand for the channel 40. Generally, the base 80 is also made of stainless steel, or the similar metal from which the channel 40 is made.

Generally, the base support 70 and the base 80 may be pre-fixed with channel 40 before installing the whole system on the roof. A person of ordinary skill in the art will understand that the assembly can be made at the time of installation of the system on the roof. In such circumstance, the base support 70, which is pre-fixed on the channel 40, is fixed on the roof after adjusting it according to the angle of roof or roof pitch. Once fixed, the base 80 is then inserted from the top of the channel and fixed on the roof. To secure the connection between the channel 40 and section 85, a cover collar 50 is inserted on to the channel 40 and towards the section 85. The collar 50 is tightened using bolt 65. Generally, the collar 50 is pre-made as one piece with the channel 40. A person of ordinary skill in the art will appreciate that the collar 50 can be made separately from the channel 40. Due to the flexibility of the section 85, the channel 40 can also be rotated around its axis. The longitudinal angle of the channel is then adjusted according to the shape of the end pipe of the chimney system that the channel spans. Once the channel is aligned with the end pipe of the chimney system, in the preferred embodiment, it is then stabilized with the end pipe using bolts 60. Typically, the bolts are made of stainless steel. The channel 40 is made with at least three bolts holes along its span at approximately half way along its perpendicular length. The bolts 60 are inserted and tightened inwardly towards the end pipe. The length of the bolts 60 is chosen according to the shape of the end pipe of the chimney system. It will be obvious to a person of ordinary skill in the art to use other means to stabilize the channel 40 with the end pipe 30. In another embodiment, a shown in FIG. 5, the channel 40 is stabilized with the end pipe 30 using spring thumbs 100. Upon stabilization of the channel 40, a crown top base 90 is placed on top of the channel. The crown base 90 is generally square shaped having a portion below the top similar to the shape of the channel but having a span smaller than the channel 40. This allows the crown top 90 to be placed inside the channel 40. For the easy passage of the gas, there are small holes along the span of the crown top.

Figure 3:
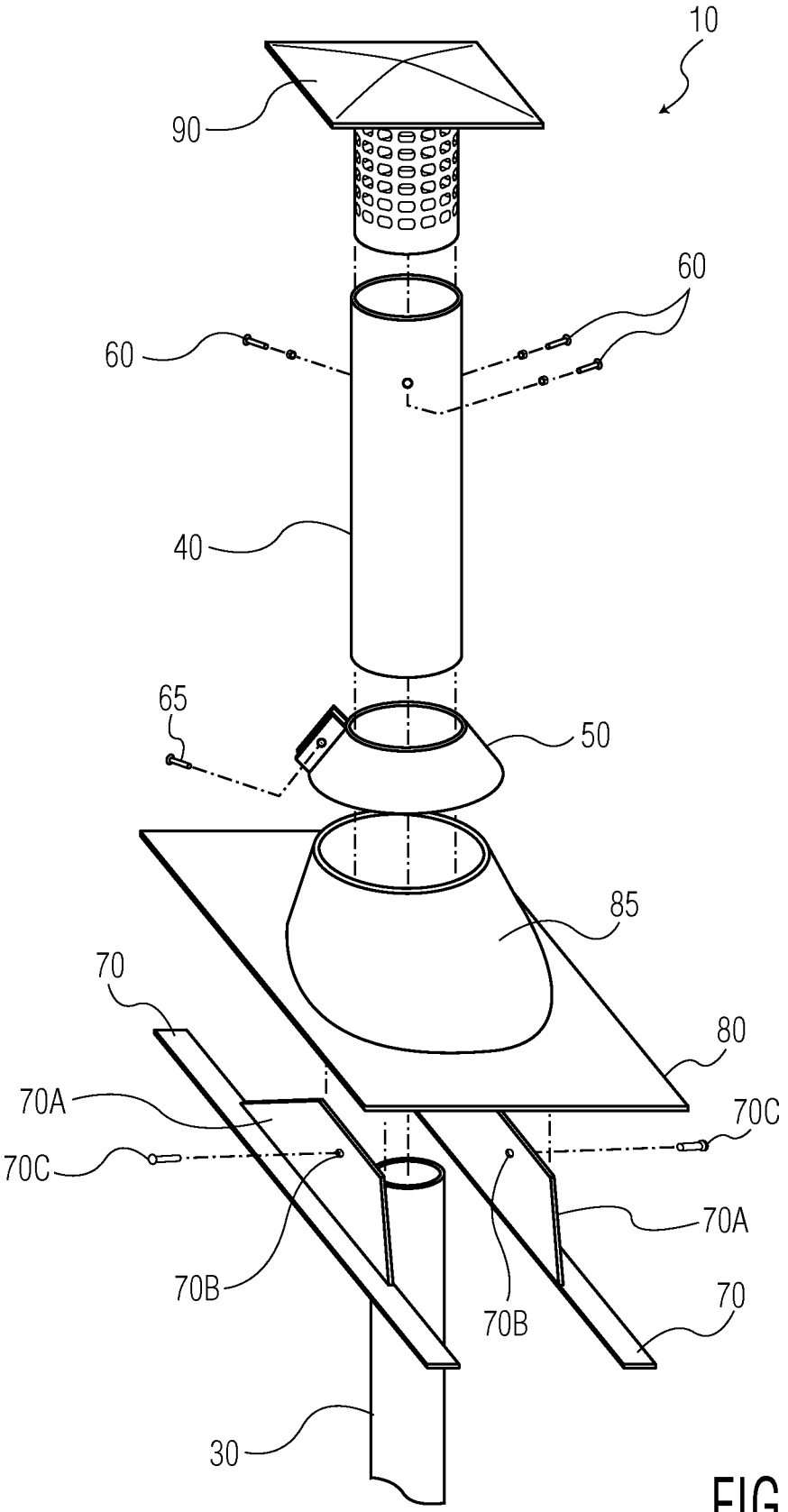
FIG. 3 is the exploded view of system of the present invention.

FIG. 3 is the shows the exploded view of the present invention. In the preferred embodiment, the length of the base supports 70 is 10-12 inches long. The base support 70 has a raised column 70A approximately 6-8 inches in length. The raised column 70A has holes 70B through which the bolts 70C are inserted and tightened near the base of the channel 40. The dimension of section 85 is such that it completely covers raised column 70A of the base supports 70.

Figure 4:
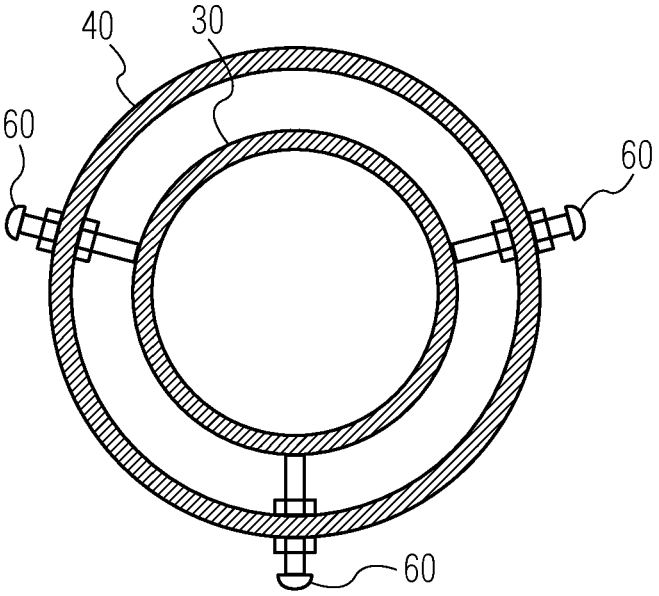
FIG. 4 is a cross-section top view of the end pipe of the chimney system protruding from the roof of a house or a building marked 4-4 in FIG. 1; the end pipe covered by the channel of the present invention being stabilized by tightening the bolts against the end pipe.
Figure 5:
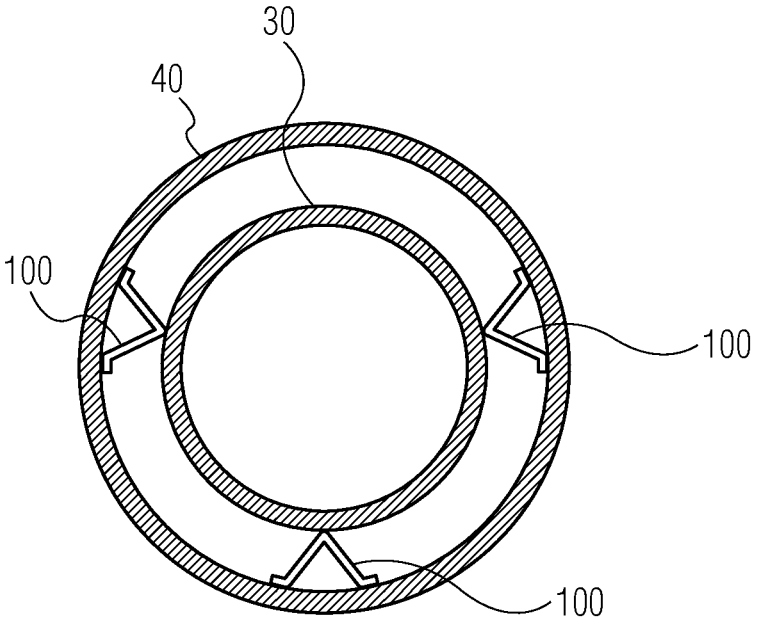
FIG. 5 is a cross-section top view of the end pipe of the chimney system protruding from the roof of a house or a building marked 5-5 in FIG. 1; the end pipe covered by the channel of the present invention being stabilized using spring thumbs tightened against the end pipe.

FIG. 4 shows the cross-section top view of the end pipe 30 longitudinally covered by the channel 40. The bolts 60 are tightened on to the wall of the end pipe. Similarly, FIG. 5 shows the cross-section top view of the end pipe 30 longitudinally covered by the channel 40. However, in FIG. 5, which is another embodiment, the channel is stabilized using spring thumbs 100 instead of using bolts.

While preferred embodiments of the disclosure have been shown and described, modifications thereof can be made by one skilled in the art without departing from the spirit and teachings of the disclosure. The claims intend to cover all such modifications and changes by one skilled in the art. The embodiments described herein are exemplary only, and are not intended to be limiting. Many variations and modifications of the disclosure disclosed herein are possible and are within the scope of the disclosure. Where numerical ranges or limitations are expressly stated, such express ranges or limitations should be understood to include iterative ranges or limitations of like magnitude falling within the expressly stated ranges or limitations. Use of the term "optionally" with respect to any element of a claim is intended to mean that the subject element is required, or alternatively, is not required. Both alternatives are intended to be within the scope of the claim. Use of broader terms such as comprises, includes, having, etc. should be understood to provide support for narrower terms such as consisting of, consisting essentially of, comprised substantially of, etc.

What is claimed is:

1. A system for covering a heated end pipe of a chimney protruding from a roof, the system comprising:

a planar base mounted on at least two base supports on top of the roof, the planar base having a protruding section with an opening to allow the chimney end pipe to extend through, the chimney end pipe being exposed in use to hot and corrosive gasses passing through the chimney, the chimney being part of a heating system of a building structure;

a clamping collar being releasably affixed around a cylindrical channel, and on top of and spaced apart from the protruding section of the planar base to cover the protruding section of the planar base, wherein a diameter of a bottom portion of the clamping collar is greater than a diameter of a top portion of the protruding section of the planar base;

the cylindrical channel having a first end, a second end, an outside surface and a lumen, the first end of the channel extending through the releasably affixed collar and extending through the opening of the protruding section of the planar base to the roof, the first end of the channel being pivotally secured to the at least two base supports above the roof by at least two geometrically identical brackets extending perpendicular from the at least two base supports, and an edge of the first end of the channel being above the roof;

a plurality of supporting members radially extending from the outside surface of the second end of the channel through the lumen of the second end of the channel to an outside surface of the chimney end pipe, the plurality of supporting members configured to contact the outside surface of the chimney end pipe and hold the second end of the channel in coaxial alignment with the chimney end pipe, the supporting members being manually adjustable from the outside surface of the channel, wherein adjusting at least one of the supporting members from the outside surface of the channel allows the second end of the channel to maintain coaxial alignment with a plurality of different chimney end pipe having different dimensions; and a channel cover having a crown top removably secured within the lumen of the cylindrical channel at the second end of the cylindrical channel.

2. The system of claim 1, wherein the channel is made of stainless steel.

3. The system of claim 1, wherein the channel is made of copper.

4. The system of claim 1, wherein the channel is made of galvanized metal.

5. The system of claim 1, wherein the channel is made of aluminum.

6. The system of claim 1, wherein the at least two base supports are connected to the channel by at least one of bolts, screws, nails, rivets, and welding.

7. The system of claim 1, wherein the at least two base supports, the clamping collar, the base, and the crown top are made of at least one of stainless steel, cooper, galvanized metal, and aluminum.

8. A system for covering a heated end pipe of a chimney protruding from a roof, the system comprising:

at least two base supports mounted on the roof on diametrically opposing sides of the chimney end pipe;

a planar base mounted on the at least two base supports, the planar base having a protruding section with an opening to allow the chimney end pipe to extend through;

a clamping collar being releasably affixed around a cylindrical channel, and on top of and spaced apart from the protruding section of the planar base to cover the protruding section of the planar base, wherein a diameter of a bottom portion of the clamping collar is greater than a diameter of a top portion of the protruding section of the planar base;

the cylindrical channel having a first end, a second end, an outside surface and a lumen, the first end of the channel extending through the releasably affixed collar and extending through the opening of the protruding section of the planar base, the first end of the channel being pivotally secured to the at least two base supports above the roof by at least two corresponding quadrilateral brackets extending perpendicular from the at least two base supports, and an edge of the first end of the channel being above the roof;

a plurality of supporting members radially extending from the outside surface of the second end of the channel through the lumen of the second end of the channel to an outside surface of the chimney end pipe, the plurality of supporting members configured to contact the outside surface of the chimney end pipe and hold the second end of the channel in coaxial alignment with the chimney end pipe, the supporting members being manually adjustable from the outside surface of the channel, wherein adjusting at least one of the supporting members from the outside surface of the channel allows the second end of the channel to maintain coaxial alignment with a plurality of different chimney end pipe having different dimensions; and a channel cover having a crown top removably secured within the lumen of the channel at the second end of the channel.

9. The system of claim 8, wherein the channel is made of at least one of stainless steel, copper, galvanized metal, and aluminum.

10. The system of claim 8, wherein the channel is stabilized using at least one of rivets, screws, and thumbs.

11. The system of claim 8, wherein the at least two base supports are connected to the channel by at least one of bolts, screws, nails, rivets, and welding.

12. The system of claim 8, wherein the at least two base supports, the clamping collar, the base, and the crown top are made of at least one of stainless steel, cooper, galvanized metal, and aluminum.

* * * * *